US011096494B1

(12) United States Patent
Tsai

(10) Patent No.: US 11,096,494 B1
(45) Date of Patent: Aug. 24, 2021

(54) FIXING STRUCTURE FOR A FOOT RING OF A CHAIR

(71) Applicant: Fusco Industrial Corporation, Taipei (TW)

(72) Inventor: Chen-Yu Tsai, Taipei (TW)

(73) Assignee: Fusco Industrial Corporation, Taipei (TW)

( * ) Notice: Subject to any disclaimer, the term of this patent is extended or adjusted under 35 U.S.C. 154(b) by 0 days.

(21) Appl. No.: 16/799,323

(22) Filed: Feb. 24, 2020

(51) Int. Cl.
*A47C 7/02* (2006.01)
*A47C 7/00* (2006.01)
*A47C 7/50* (2006.01)

(52) U.S. Cl.
CPC ..... *A47C 7/02* (2013.01); *A47C 7/004* (2013.01); *A47C 7/5064* (2018.08)

(58) Field of Classification Search
CPC ..... A47C 7/004; A47C 7/02; A47C 7/5064
See application file for complete search history.

(56) References Cited

U.S. PATENT DOCUMENTS 1,970,624 A * 8/1934 Recker ..... F21V 21/22 248/412
3,458,234 A * 7/1969 Bates ..... A47C 7/004 297/423.38
4,253,632 A * 3/1981 Doerner ..... A47C 7/004 248/405
5,988,754 A * 11/1999 Lamart ..... A47C 7/506 297/423.38
6,520,192 B1 * 2/2003 Lo ..... A45B 19/04 135/114
6,578,804 B2 * 6/2003 Lin ..... A47C 7/004 248/188.1
6,695,407 B1 * 2/2004 Lin ..... A47C 1/02 297/423.38
6,761,274 B1 * 7/2004 Chen ..... A47B 45/00 211/204
6,862,776 B2 * 3/2005 Chen ..... F16B 7/1463 16/113.1
7,387,343 B1 * 6/2008 Hsieh ..... A47C 7/5064 297/423.38
8,991,928 B2 * 3/2015 Hsieh ..... A47C 7/5064 297/423.25
9,144,315 B1 * 9/2015 Cheng ..... A47C 7/506
(Continued)

FOREIGN PATENT DOCUMENTS

TW 298787 2/1997
TW 516411 1/2003

*Primary Examiner* — James M Ference
(74) *Attorney, Agent, or Firm* — Wang Law Firm, Inc.

(57) ABSTRACT

A fixing structure for a foot ring of a chair includes a hub with a central hole formed with internal threads on an inner surface thereof; and a bush being a cylindrical body having a tapered outer surface with external threads. The bush has a shaft hole penetrating along a longitudinal axis of the bush, a groove penetrating through a wall of the bush, and at least one pad provided on an inner surface of the shaft hole. The bush is assembled with the hub by screwing the external threads of the bush with the internal threads of the hub. A supporting post penetrates through the shaft hole. When the bush rotates toward a first direction, the shaft hole is reduced to clamp and fix the supporting post, and when the bush rotates toward a second direction, the shaft hole is enlarged to release the supporting post.

5 Claims, 8 Drawing Sheets

(56) References Cited

U.S. PATENT DOCUMENTS

| | | | | |
|---|---|---|---|---|
| 9,220,346 | B1 * | 12/2015 | Wu | A47C 7/5064 |
| 9,578,969 | B1 * | 2/2017 | Su | A47C 7/5064 |
| 9,835,191 | B1 * | 12/2017 | Chen | A47C 7/50 |
| 2003/0151291 | A1 * | 8/2003 | Lin | A47C 7/5064<br>297/423.38 |
| 2006/0175518 | A1 * | 8/2006 | Hu | A47C 7/5066<br>248/425 |
| 2011/0226925 | A1 * | 9/2011 | Tsai | A47C 7/5064<br>248/411 |
| 2014/0070592 | A1 * | 3/2014 | Yeh | A47C 7/5064<br>297/423.38 |
| 2014/0265512 | A1 * | 9/2014 | Pritchard | A47C 7/5064<br>297/423.38 |
| 2017/0105534 | A1 * | 4/2017 | Su | A47C 7/506 |

* cited by examiner

FIXING STRUCTURE FOR A FOOT RING OF A CHAIR

BACKGROUND OF THE INVENTION

1. Field of the Invention

The present invention relates to a chair with a foot ring in the field of furniture, more particular to a fixing structure for fixing the foot ring to a supporting post or a pneumatic cylinder for controlling the lifting of a seat of the chair.

2. The Prior Arts

Some chairs are provided with a foot ring at an appropriate height position of a supporting post used to support a seat, so that people's feet can be placed on the foot ring while sifting on the seat and feel comfortable.

A conventional foot ring of a chair includes a ring body and a hub arranged concentrically, and a plurality of spokes radially arranged between an inner periphery of the ring body and an outer periphery of the hub. The hub has a central hole for a supporting post or a pneumatic cylinder, which is used to support the seat of the chair, to penetrate through.

Some early foot rings for a chair were made by a fixed manner (that is, the height position of the foot rings cannot be adjusted), so those with a larger size may feel uncomfortable due to their knees bending too much when sifting, and those with a smaller size may also feel uncomfortable due to their knees stretching too much.

Taiwanese Utility Patent No. 298787 provides a fixing device for ascending/descending a foot ring of a chair, which includes a clamping ring with a slot provided in a central hole of a hub of the foot ring. A sliding groove is provided axially on an inner wall of the hub, and a pressing sheet is arranged therein. The hub is provided with a screw hole radially extending through the inner wall of the hub and corresponding to the sliding groove for being fitted with a screw coupled to a knob. After a supporting post is inserted into the clamping ring, the screw coupled to the knob can be used to press against the pressing sheet for controlling whether the clamping ring is fixed to the supporting post or not. That is, when the clamping ring is not clamped and fixed, the height position of the foot ring on the supporting post can be adjusted up and down; and when a desired height position of the foot ring is reached, the clamping ring is clamped and fixed.

However, since the pressing sheet is straight shape, when the screw coupled to the knob acts on the pressing sheet, the straight-shape pressing sheet only acts on a point of an outer surface of the clamping ring, so that the wall of the clamping ring on one side of the groove has a larger deformation, while the wall of the clamping ring on the other side of the groove is almost not deformed, which causes the clamping ring to receive an uneven force and thus reduces a clamping force of the clamping ring on the supporting post.

Taiwanese Utility Patent No. 516411 provides an improved foot ring for a chair, which has a hub with a sliding groove on an inner wall and in parallel to a central axis thereof, and an arc-shape pressing sheet arranged in the sliding groove. A clamping ring with a slot is disposed in a central hole of the hub, so as to provide two ends of the arc-shape pressing sheet against two sides of the slot of the clamping ring. A screw coupled to a knob is screwed into a screw hole on the wall of the hub. A user can control whether the clamping ring is fixed to a supporting post penetrated through the clamping ring or not by tightening or loosening the knob.

SUMMARY OF THE INVENTION

The objective of the present invention is to provide a fixing structure for a foot ring of a chair with a more simplified structure and an easier operation.

The technical means of the present invention is to provide a fixing structure for a foot ring of a chair, comprising: the foot ring having a ring body, a hub arranged concentrically with the ring body, and a plurality of spokes radially arranged between an inner periphery of the ring body and an outer periphery of the hub, wherein the hub has a central hole formed with internal threads on an inner surface thereof; and a bush being a cylindrical body having a tapered outer surface with external threads formed thereon, wherein the bush has a shaft hole penetrating along a longitudinal axis of the bush, a groove penetrating through a wall of the bush, and at least one pad provided on an inner surface of the shaft hole, which is softer relative to the inner surface of the shaft hole and has a relatively high coefficient of friction, wherein the bush is assembled with the hub by screwing the external threads of the bush with the internal threads of the hub, a supporting post penetrates the shaft hole of the bush, and when the bush rotates toward a first direction, the wall of the bush is restricted by the central hole and the inner diameter of the shaft hole is reduced to clamp and fix the supporting post, when the bush rotates toward a second direction, the wall of the bush restricted by the central hole is released to make the shaft hole enlarge to release the clamping and fixing of the supporting post, wherein the first direction and the second direction are opposite to each other.

Preferably, an outer edge of a large diameter end of the tapered bush is formed with a flange protruding radially outward, so that the bush can rotate into the central hole of the hub until the flange is obstructed by an edge of the hub.

Preferably, opposite sidewalls of the groove have a width spaced apart from each other, and form an angle in a widthwise direction thereof, so that when the bush rotates into the central hole of the hub to reduce the inner diameter of the shaft hole, the two sidewalls of the groove gradually close to each other, and finally may contact with each other.

In a suitable embodiment, the angle between the two sidewalls of the groove may be 5°~8°.

In a suitable embodiment, the width between the two sidewalls of the groove may be 5~10 mm.

Preferably, two pads may be disposed on and protrude from opposite sides of the inner surface of the shaft hole.

Preferably, two recesses may be formed on opposite sides of the inner surface of the shaft hole, and the pads are respectively fixed in the recesses.

In a suitable embodiment, the pads may be adhesively fixed on a bottom surface of the recess.

In a suitable embodiment, the pads may be made of silicone or rubber material.

In a suitable embodiment, the supporting post may be a pneumatic cylinder for providing a seat of the chair to be raised or lowered.

Compared with the conventional fixing structure of a foot ring for a chair, the fixing structure of the present invention used to fix the foot ring to a supporting post or a pneumatic cylinder is simple, easy to be assembled, and easy to adjust the height position of the foot ring on the supporting post.

DETAILED DESCRIPTION OF THE PREFERRED EMBODIMENT

The following describes the implementation of the present invention in more detail with drawings and numerals, so that those skilled in the art can implement it after studying the present specification.

Figure 1:
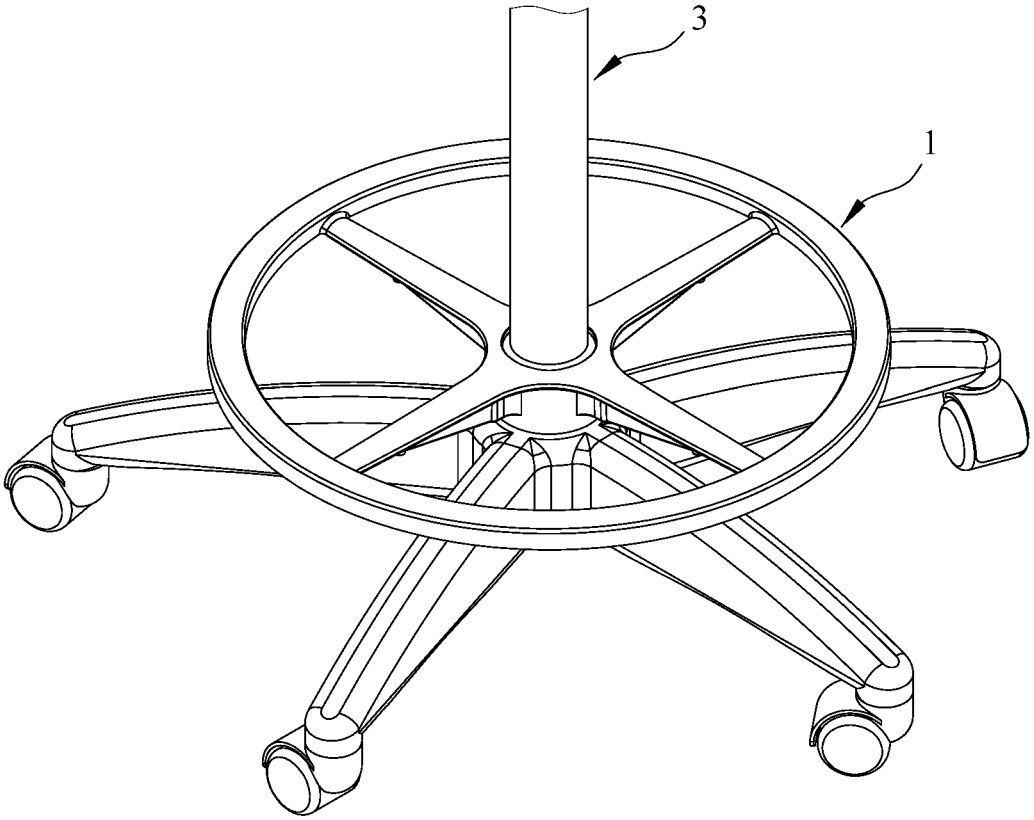
FIG. 1 illustrates a schematic perspective view of a foot ring according to an embodiment of the present invention, which is assembled on a supporting post of a chair.

As shown in FIG. 1, the foot ring 1 of the present invention is assembled at an appropriate height position of a supporting post 3 of a chair, so that the feet of a user sitting on the chair can step thereon and feel comfortable. The fixing structure is to allow the foot ring 1 to be quickly, stably and firmly mounted on the supporting post 3. The chair is suitable for a chair having a single supporting post, such as an office chair and a high chair.

The supporting post 3 may be a rod generally used to support a chair, or may be a pneumatic cylinder used to support a seat of a chair and capable of controlling the seat to be raised or lowered in a vertical direction.

Figure 2:
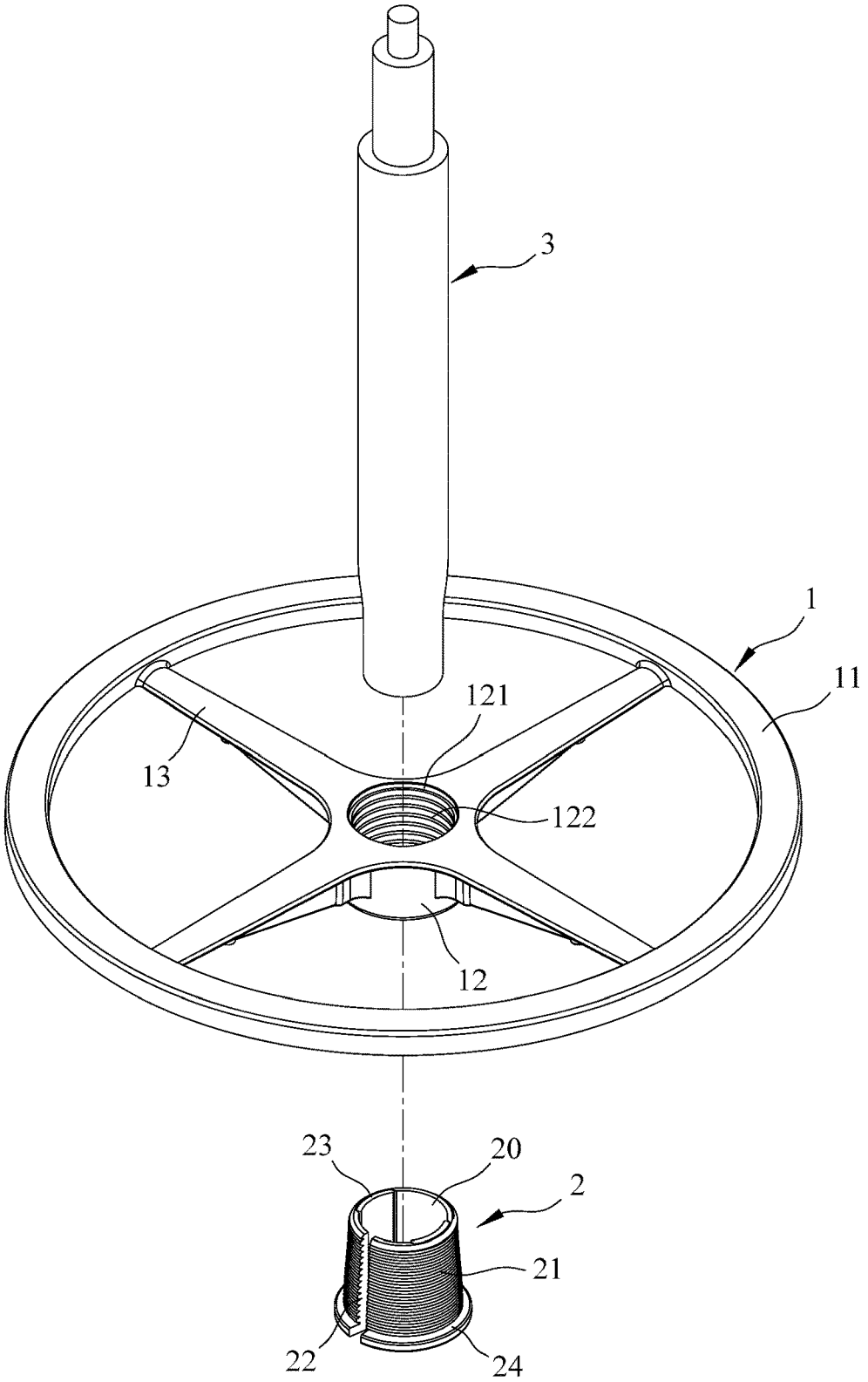
FIG. 2 illustrates an exploded perspective view of an assembled relationship of the foot ring, the bush and the supporting post.

As shown in FIG. 2, the fixing structure of the foot ring for a chair provided in the present invention preferably comprises a foot ring 1 and a bush 2. The foot ring 1 can be made of any suitable material, for example, which is made of aluminum alloy material by casting. The foot ring 1 has a ring body 11 and a hub 12 arranged concentrically each other, and a plurality of spokes 13 are radially arranged between an inner periphery of the ring body 11 and an outer periphery of the hub 12. The spokes 13 connect the ring body 11 and the hub 12 together and maintain both at a concentric position. The hub 12 has a central hole 121, which is formed with internal threads 122 on an inner surface thereof by turning.

Figure 3:
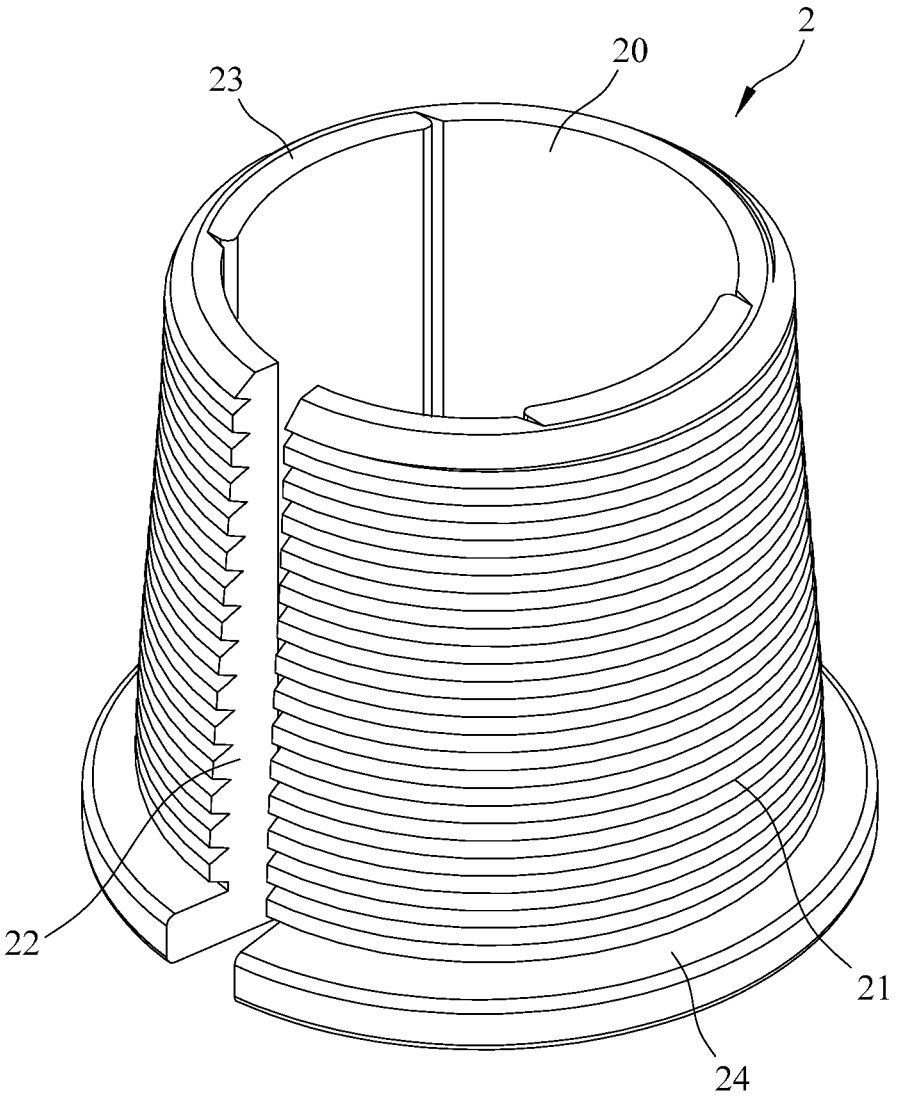
FIG. 3 illustrates an exploded perspective view of an assembled structure of the bush and the pads.
Figure 4:
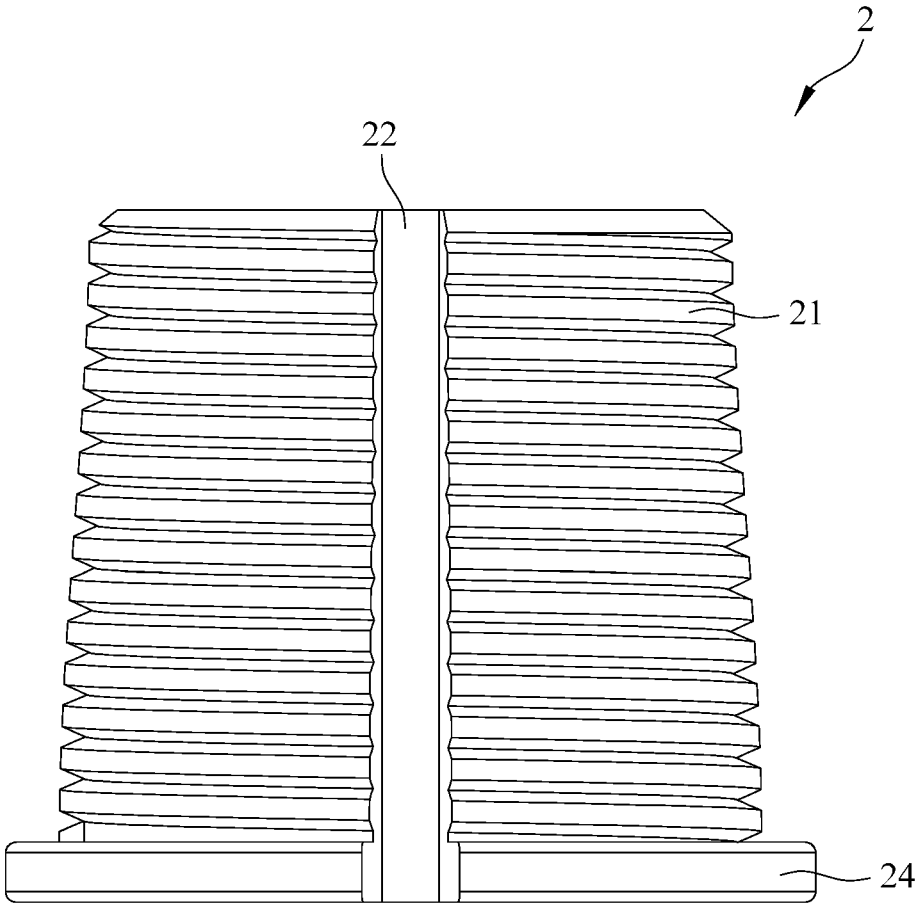
FIG. 4 illustrates a front view of the bush.
Figure 5:
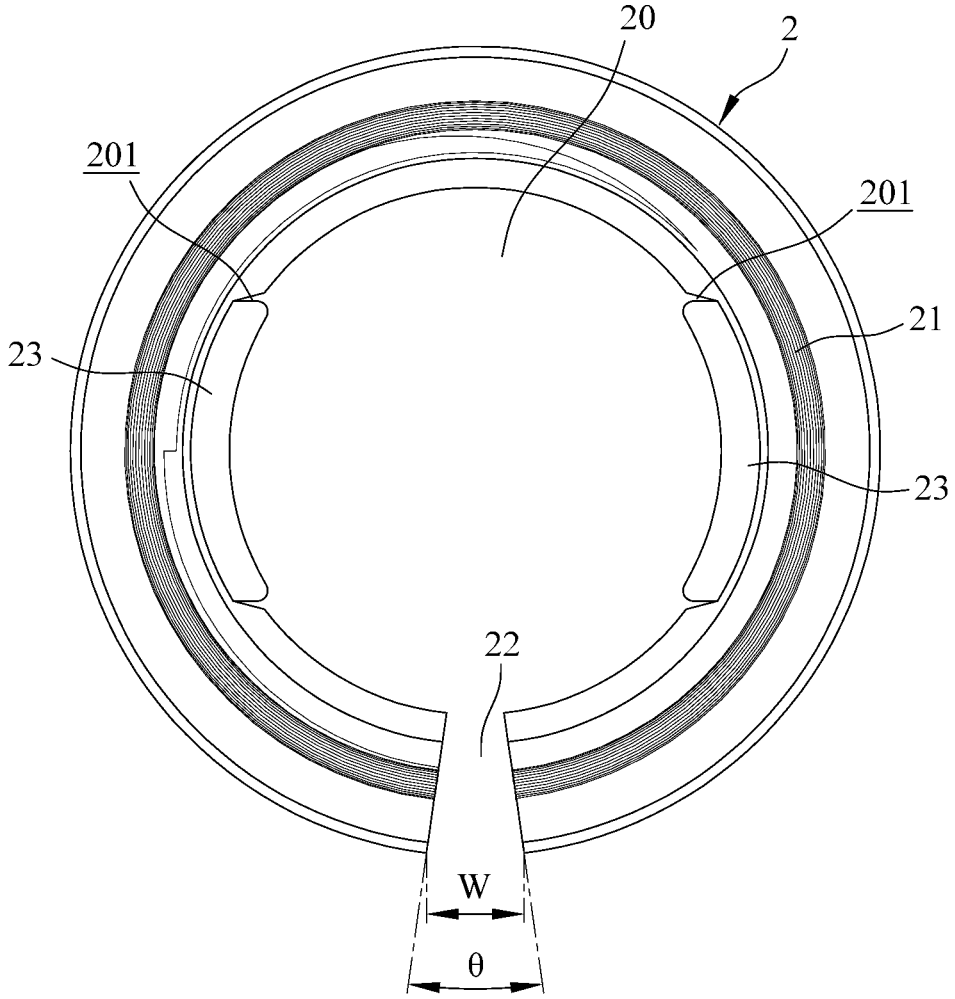
FIG. 5 illustrates a top view of the bush.

As shown in FIGS. 3 to 5, the bush 2 can be integrally formed by a plastic material, a composite material or any suitable material to be a cylindrical body having a tapered outer surface with external threads 21 formed thereon, so as to form the bush 2 with a shaft hole 20 penetrating along a longitudinal axis of the bush. An outer edge of the large diameter end of the tapered-shape bush 2 is formed with a flange 24 protruding radially outward. A groove 22 is formed to penetrate through a wall of the bush 2. Two opposite sidewalls of the groove have a width W spaced apart from each other, and form an angle θ in a widthwise direction thereof. The angle θ is preferably 5° to 8°, and the width W is preferably 5 mm to 10 mm. The groove 22 may provide the wall of the bush 2 to be elastically deformed in a radial direction, so as to elastically reduce or enlarge an inner diameter of the shaft hole 20. The angle θ may provide the opposite sidewalls of the groove 22 to be close to each other when the shaft hole 20 is reduced to a certain degree.

The width W of the groove 22 should be suitably set, so as to provide a sufficient contact area for obtaining an enough clamping force between an outer surface of the supporting post 3 and the inner surface of the shaft hole 20 when the supporting post 3 penetrates through the shaft hole 20. In other words, if the width W is too large, the inner surface area of the shaft hole 20 will decrease, and thus the contact area between the outer surface of the supporting post 3 and the inner surface of the shaft hole 20 will decrease, thereby reducing the frictional force of the contact surface of the inner surface of the shaft hole 20 with the outer surface of the supporting post 3. In contrast, if the width W is too small, although the inner surface area of the shaft hole 20 is relatively increased, an deformation amount of the bush 2 in the radial direction will be decreased due to the contact of the opposite sidewalls of the groove 22 with each other, and thereby decreasing the clamping force of the bush 2 on the supporting post 3. Therefore, the optimal width W of the groove 22 at an outer edge of the bush 2 is 5 mm to 10 mm.

In the preferred embodiment of the present invention, at least one pad 23 may be further provided on the inner surface of the shaft hole 20, and the at least one pad 23 may protrude from the inner surface of the shaft hole 20. The pad 23 is softer relative to the inner surface of the shaft hole 20 and has a high coefficient of friction. For example, the pad 23 may be made of silicone or rubber material. Preferably, recesses 201 may be formed on opposite sides of the inner surface of the shaft hole 20, and two pads 23 are respectively disposed in the recesses 201. For example, the pad 23 may be fixed on a bottom surface of the recess 201 with an adhesive; or the pad 23 may be pressed into the recess 201 in a tight fit manner.

The operation method of fixing the foot ring 1 to the supporting post 3 using the fixing structure is described below: The bush 2 is assembled with the hub 12 by spirally fitting the internal thread 122 with the external thread 21, so as to make the bush 2 penetrate into the central hole 121 along the longitudinal axis thereof. Since the bush 2 having a tapered outer surface is fitted with the central hole 121 having an uniform inner diameter, the wall of the bush 2 will be gradually restricted by the central hole 121 and radially deformed to shrink during a process of rotating the bush 2 toward a first direction (for example, clockwise) into the central hole, and thus to reduce the inner diameter of the shaft hole 20 until the flange 24 abuts against a lower edge of the hub 12. In contrast, when rotating the bush 2 toward a second direction (for example, counterclockwise), the wall of the bush 2 restricted by the central hole 121 will be gradually released and radially expanded while the bush 2 gradually rotates out of the central hole 121, and thus enlarge the inner diameter of the shaft hole 20.

Figure 6:
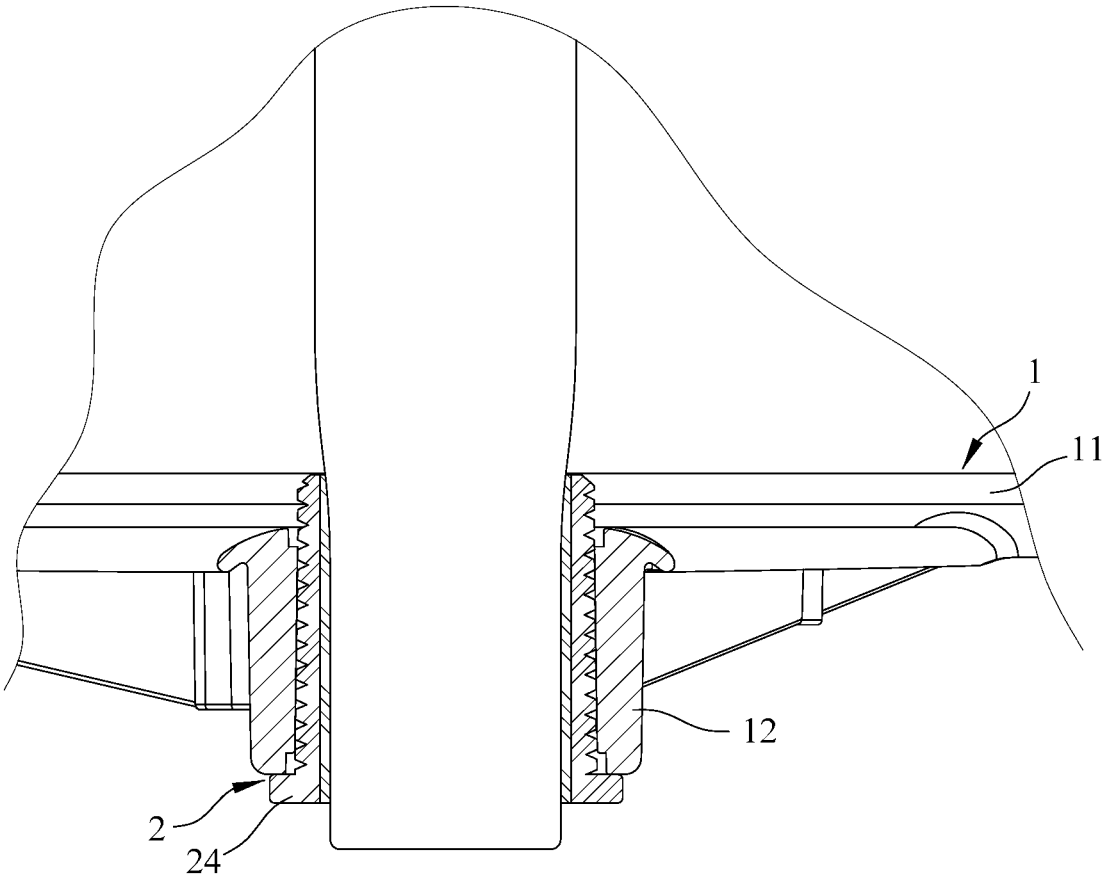
FIG. 6 illustrates a front sectional view showing the foot ring and the bush fixedly assembled with the supporting post.
Figure 7:
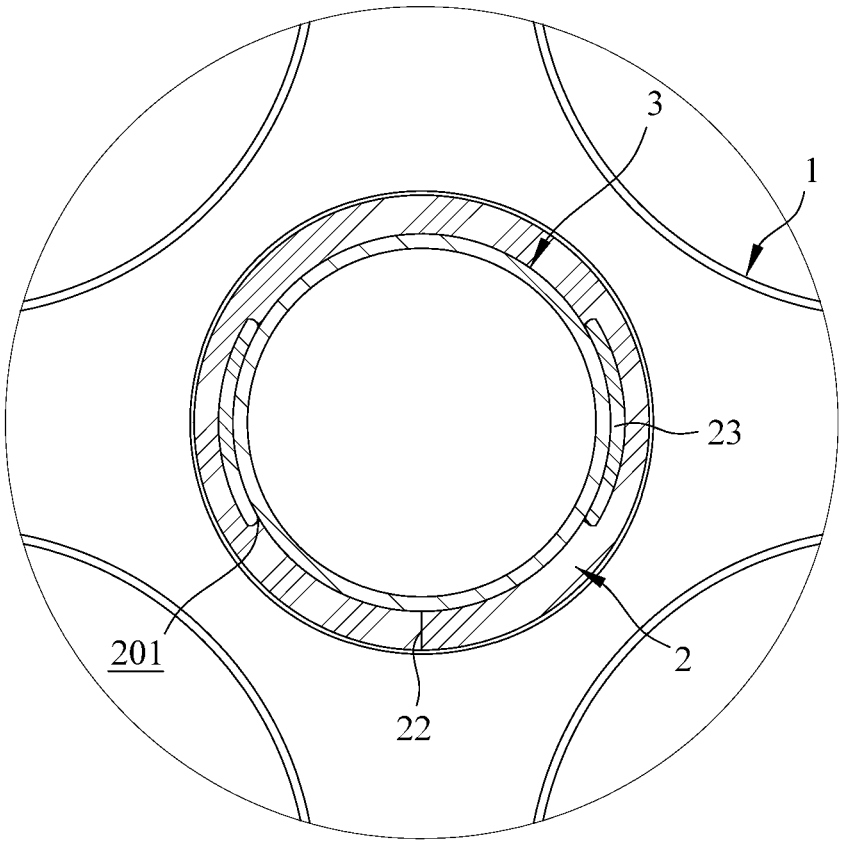
FIG. 7 illustrates a top plan sectional view showing the foot ring and the bush fixedly assembled with the supporting post.
Figure 8:
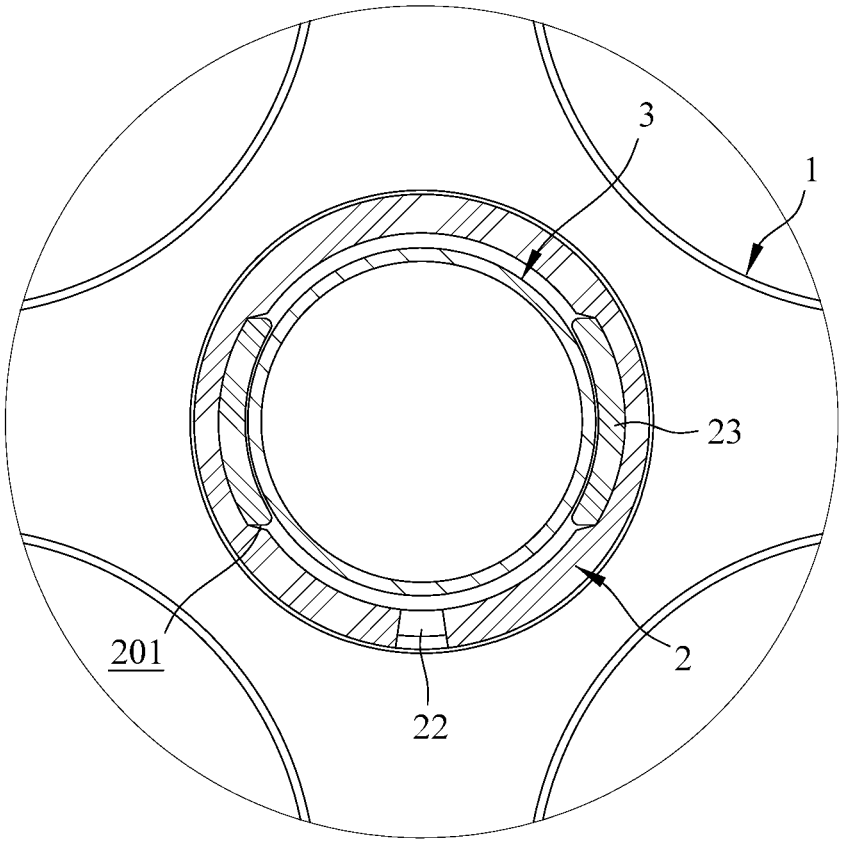
FIG. 8 illustrates a top plan sectional view showing a state in which the foot ring and the bush are released from the supporting post.

Therefore, when assembling the foot ring 1 on the supporting post 3, the bush 2 should be rotated firstly and moved outward from the central hole 121 for enlarging the inner diameter of the shaft hole 20 to allow the supporting post 3 to penetrate through, and then insert the supporting post 3 into the shaft hole 20, and then rotate and move the bush 2 inward the central hole 121. As described above, the shaft hole 20 will be shrunk during the movement of the bush 2 into the shaft hole 20, and thus the inner diameter of the shaft hole 20 is decreased to clamp and fix the supporting post 3, as shown in FIGS. 6 to 7. In particular, since the soft pads 23 provided on the shaft hole 20 protrudes from the inner surface of the shaft hole 20, the pads 23 will be compressed to deform during the process of clamping the supporting post 3 with the shaft hole 20 of the bush, so that the supporting post 3 can be supported and clamped by the pads 23 with a higher friction coefficient. Similarly, when needing the adjustment of the foot ring 1 to other height positions, the bush 2 is rotated to release the clamping on the supporting post 3, as shown in FIG. 8, the foot ring 1 can be moved upward and downward along the supporting post 3, and then the bush 2 is rotated toward a reverse direction to fix it on the supporting post 3 after a desired height position is reached.

The above description is only for explaining the preferred embodiments of the present invention, and is not intended to limit the present invention. Therefore, any form of the changes should be included in the scope of the invention as claimed.

What is claimed is:

1. A structure for fixing a foot ring to a chair, comprising:

a ring body, a hub arranged concentrically with the ring body, and a plurality of spokes radially arranged between an inner periphery of the ring body and an outer periphery of the hub, wherein the hub has a central hole formed with internal threads on an inner surface thereof; and a bush being a cylindrical body having a tapered outer surface with external threads formed thereon, wherein the bush has a shaft hole penetrating along a longitudinal axis of the bush, wherein two recesses are formed on the opposite sides of the inner surface of the shaft hole, the two recesses are respectively extending through the inner surface along the longitudinal axis of the bush, and two pads are respectively disposed on and protrude from the two recesses, the two pads are softer and having a higher coefficient of friction compared to a coefficient of friction of the inner surface of the shaft hole, and a groove penetrating through a wall of the bush, wherein two opposite sidewalls of the groove have a width spaced apart from each other, and form an angle in a widthwise direction thereof, wherein the range of the angle is 5° to 8°, wherein the range of the width is 5 to 10 mm, and wherein the bush is assembled with the hub by screwing the external threads of the bush with the internal threads of the hub, a supporting post penetrates through the shaft hole of the bush, and when the bush rotates toward a first direction, the wall of the bush is restricted by the central hole and the inner diameter of the shaft hole is reduced to clamp and fix the supporting post, when the bush rotates toward a second direction, the wall of the bush restricted by the central hole is released to make the shaft hole enlarge to release the clamping and fixing of the supporting post, wherein the first direction and the second direction are opposite to each other.

2. The fixing structure of claim 1, wherein an outer edge of a large diameter end of the tapered bush is formed with a flange protruding radially outward.

3. The fixing structure of claim 1, wherein the two pads are adhesively fixed on a bottom surface of the two recesses.

4. The fixing structure of claim 1, wherein the two pads are made of silicone or rubber material.

5. The fixing structure of claim 1, wherein the supporting post is a pneumatic cylinder for providing a seat of the chair to be raised or lowered.

* * * * *